United States Patent [19]

Sasser et al.

[11] Patent Number: 4,599,584

[45] Date of Patent: Jul. 8, 1986

[54] POWER DIVIDER/COMBINER APPARATUS COMPRISING A FAN SHAPED WAVEGUIDE

[75] Inventors: Bill H. Sasser, Tempe; Roger J. Eckstein, Phoenix; Kenneth Engle, Scottsdale, all of Ariz.

[73] Assignee: Motorola, Inc., Schaumburg, Ill.

[21] Appl. No.: 665,321

[22] Filed: Oct. 26, 1984

[51] Int. Cl.[4] ..... H01P 5/12

[52] U.S. Cl. ..... 333/125; 333/137; 333/248; 343/776

[58] Field of Search ..... 333/125, 136, 137, 127, 333/128, 248; 343/776, 777; 331/56, 96, 107 P; 330/295, 56, 293

[56] References Cited

U.S. PATENT DOCUMENTS

| | | | |
|---|---|---|---|
| 2,540,839 | 2/1931 | Southworth | 333/125 X |
| 3,157,847 | 11/1969 | Williams | 333/248 X |
| 3,218,580 | 11/1965 | Zanichkowsky | 333/125 |
| 3,277,489 | 10/1966 | Blaisdell | 333/125 X |
| 3,775,709 | 11/1973 | Firmain et al. | 333/33 X |
| 4,463,326 | 7/1984 | Hom | 333/128 |

OTHER PUBLICATIONS

Sanders, B. J.; 110-Way Parallel Plate RF Divider/-Combiner and Solid-State Module; 2nd *Military Microwave Conf. Proc.;* 10/1980, pp. 185-193.

*Primary Examiner*—Eugene R. LaRoche
*Assistant Examiner*—Benny T. Lee
*Attorney, Agent, or Firm*—Eugene A. Parsons

[57] ABSTRACT

A generally fan shaped electrically conducting base member defining a waveguide cavity with a waveguide input/output in communication with the cavity at the apex thereof and a plurality of output/input waveguides in communication with the cavity equal angularly spaced along the arc of the base member. The inputs and outputs are formed in the plane of the cavity so that losses are substantially reduced and all of the output/input waveguides are equally spaced along radii of the base member and are of equal length so that signals at the outlets thereof are of equal amplitude and phase without requiring phase shifters and the like.

11 Claims, 5 Drawing Figures

FIG. 1
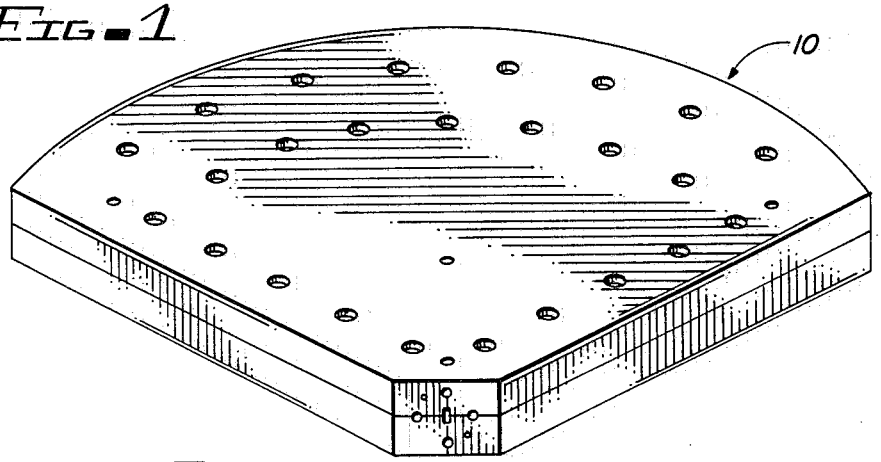
FIG. 2
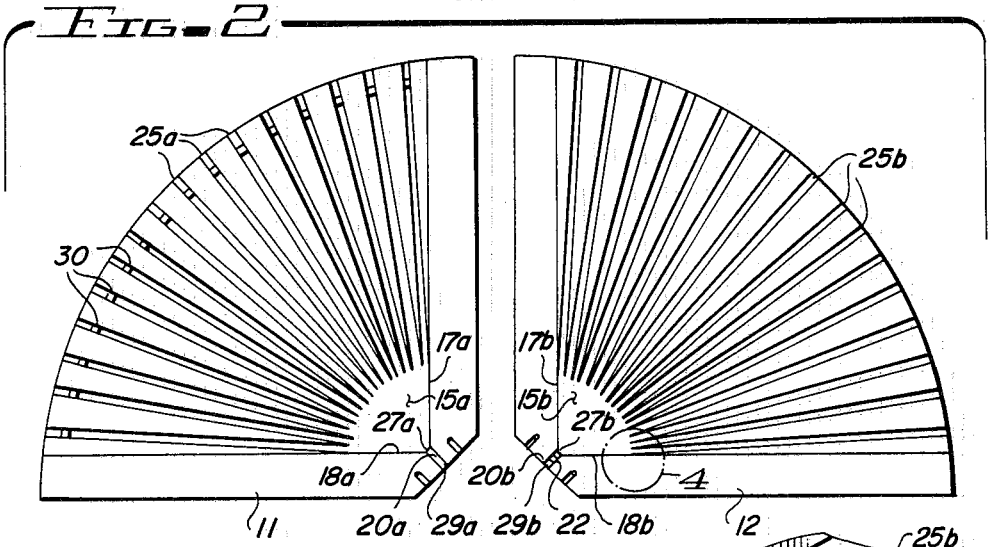
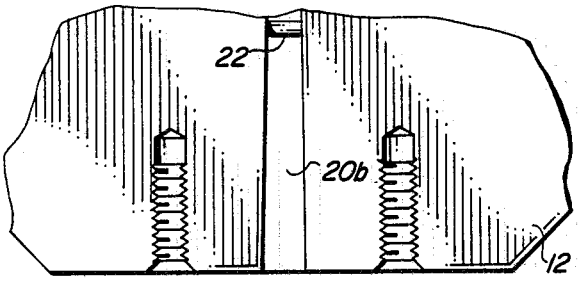
FIG. 3
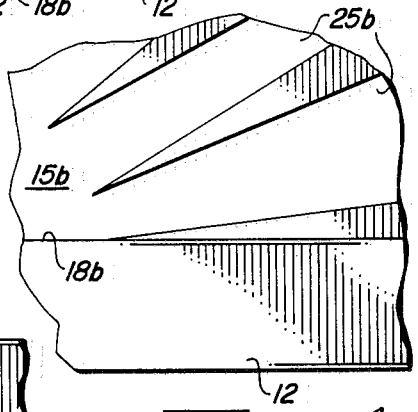
FIG. 4
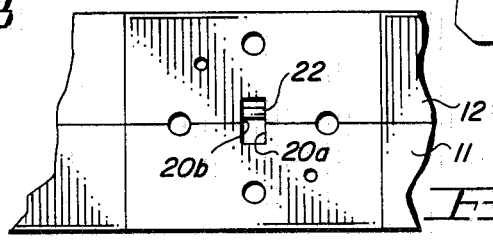
FIG. 5

POWER DIVIDER/COMBINER APPARATUS COMPRISING A FAN SHAPED WAVEGUIDE

BACKGROUND OF THE INVENTION

In the RF field, and especially into the gigahertz ranges, it is extremely difficult to amplify signals sufficiently to achieve required power levels for transmission and the like. This is especially true when the circuitry is limited to semiconductor devices.

One method known in the art, to achieve relatively high power levels utilizing semiconductor devices, is to divide the signal into a plurality of paths, amplify the divided signal in each path in a semiconductor amplifier and recombine all of the amplified signals to provide a single signal having the desired power. The dividing/-combining processes were generally performed in one of two ways in the prior art. In the first method the power is simply divided into two separate paths by a 2:1 divider, such as a Wilkinson network or the like. The two outputs are then each divided again into two outputs and the resulting four outputs are each divided into two outputs, etc., until a sufficient number of paths is obtained to provide the desired amplification of the signal. After each of the output signals is amplified a combiner network is provided, which network is the same as the divider but in a reverse order.

A second method of dividing a signal into a plurality of paths is to utilize a radial mode power divider having output ports over 360°. In this structure the input signal is introduced at the axis of a circular cavity and a plurality (110 in some instances) of outputs are spaced around the circumference of the cavity. However, this structure is relatively difficult to construct and operate since the input/output signal must be introduced at the axis of the circle and, therefore, must be supplied to a 360° radiator so as to be properly distributed in a 360° radial mode in the cavity. The coupling between diametrically opposed output ports of the 360° divider is always high, because any power reflected by (or input into) an output port is not distributed uniformly. Thus, the 360° divider has relatively high losses and mutual coupling between ports.

SUMMARY OF THE INVENTION

The present invention pertains to a power divider/-combiner including a base member formed of electrically conducting material and defining a generally fan shaped waveguide cavity therein, said cavity having a pair of side walls extending radially in a plane through said base member from an apex of the fan, an input/output waveguide channel formed in said base member in communication with said waveguide cavity and lying generally in said plane, and a plurality of output/input waveguide channels formed in said base member in communication with said waveguide cavity and extending radially outwardly from said cavity with substantially equal angular spacings therebetween. Each of the output/input waveguide channels is substantially equal in length so that a signal supplied to the input appears in each of the outputs with equal amplitude and phase without requiring phase shifters or the like.

It is an object of the present invention to provide new and improved power divider/combiner apparatus.

It is a further object of the present invention to provide new and improved power divider/combiner apparatus requiring no additional phase shifters to produce equal amplitude and phase signals at the outputs thereof.

It is a further object of the present invention to provide new and improved power divider/combiner apparatus having relatively low loss and low mutual coupling.

These and other objects of the present invention will become apparent to those skilled in the art upon consideration of the accompanying specification, claims and drawings.

BRIEF DESCRIPTION OF THE DRAWINGS

Referring to the drawings,

FIG. 1 is a view in perspective of a power divider/-combiner embodying the present invention;

FIG. 2 is a view in perspective of the power divider/-combiner of FIG. 1 disassembled to illustrate the interior structure;

FIG. 3 is a magnified view of a portion of one of the pieces of FIG. 2;

FIG. 4 is a magnified view of a portion of one of the pieces of FIG. 2; and FIG. 5 is a magnified end view of an output/input of FIG. 1, portions thereof broken away.

DESCRIPTION OF THE PREFERRED EMBODIMENT

Referring specifically to FIGS. 1 and 2 a power divider/combiner embodying the present invention is illustrated. The combiner includes a base member generally designated 10 formed of two halves or pieces 11 and 12, which are mirror images of each other. The pieces 11 and 12 are illustrated in the assembled position in FIG. 1 and are opened in FIG. 2 to illustrate the internal construction thereof. As can be seen in FIG. 2, the bottom and top pieces 11 and 12 define a generally fan shaped waveguide cavity 15(*a* and *b*) therebetween having a first side wall 17(*a* and *b*) and a second side wall 18(*a* and *b*). It should be noted that side walls 17(*a* and *b*) and 18(*a* and *b*) are actually composed of side wall portions 17*a* and 18*a* of piece 11 and side wall portions 17*b* and 18*b* of piece 12, which portions cooperate when assembled to form the completed side walls. Throughout the description of FIG. 2 a single number followed by (a and b) will be used to designate the various parts but it will be clear that a portion of piece 11, designated with an "a", will cooperate with a similar portion of piece 12, designated with a "b", to form the complete structure. The cavity 15(*a* and *b*) lies in a plane through the base member 10 with the side walls 17(*a* and *b*) and 18(*a* and *b*) radiating outwardly in the plane from an axis of rotation perpendicular to the plane. In the specific embodiment, shown an angle of 90° is defined between the side walls 17(*a* and *b*) and 18(*a* and *b*).

An input/output waveguide channel 20(*a* and *b*) is formed at the apex of the side walls 17(*a* and *b*) and 18(*a* and *b*) so as to extend from the cavity 15(*a* and *b*) to the external edge of base member 10. In this specific embodiment the channel 20(*a* and *b*) is formed the same width and depth in both pieces 11 and 12 so that when they are assembled the waveguides longest dimension is perpendicular to the plane of the cavity 15(*a* and *b*). Further, the depth of the cavity 15(*a* and *b*) is the same as channel 20(*a* and *b*). It will of course be understood by those skilled in the art that the channel and cavity might be situated with the long dimension thereof in the plane of the cavity. Referring specifically to FIG. 3 an enlarged view of the input/output wavguide channel 20(*a* and *b*) is illustrated. Since the channel opens directly into cavity 15(*a* and *b*) there is a reactive component produced at the communicating end thereof, which component has a tendency to produce standing waves at the input (exterior opening of channel 20(*a* and *b*). An inductance 22 is positioned in channel 20(*a* and *b*) to provide a reactance which counteracts the reactive component produced in channel 20(*a* and *b*) and reduces the standing waves therein. The inductance 22 is positioned empirically in channel 20(*a* and *b*) to provide the minimum standing waves. As can be seen in FIG. 1 and the magnified view of FIG. 5, four screw holes and a pair of alignment holes are provided at the outer edge of base member 10 to connect an external waveguide to channel 20(*a* and *b*).

A plurality of output/input waveguide channels 25(*a* and *b*) are formed in base member 10 so as to communicate with cavity 15(*a* and *b*) at one end thereof and to radiate outwardly therefrom to the outer circumference of base member 10. The waveguide channels 25(*a* and *b*) are spaced with equal angles therebetween and base member 10 is constructed so that the channels are of equal length so that signals passing from cavity 15(*a* and *b*) outwardly in each of the channels 25(*a* and *b*) are of equal amplitude and phase. In this specific embodiment 16 channels 25(*a* and i b) are provided in the 90° area. Each of the spacings between channels 25(*a* and *b*) is tapered inwardly toward cavity 15(*a* and *b*) and should ultimately be tapered to a thin edge, or a point in the plane through cavity 15(*a* and *b*) and base member 10, as can be seen more clearly in the magnified view of FIG. 4. It has been found that the tapered edges of the spacings between channels 25(*a* and *b*) should be as sharp as possible since any surface at this edge causes reflections in the cavity and subsequent spikes in the output of the system.

The power divider/combiner described herein is basically a radial mode power divider which propagates a mode between the two parallel plates of pieces 11 and 12 forming cavity 15(*a* and *b*). The mode is propagated in a radial direction from the outlet of input/output waveguide 20(*a* and *b*) to the output/input channels 25(*a* and *b*) spaced around the circumference of the base member 10. The mode can be polarized perpendicular to pieces 11 and 12 (Quasi TEM) or parallel to pieces 11 and 12 (Quasi TE). Structures for generating these modes are basically omni-directional antennas having either vertical or horizontal polarization. The horizontal mode offers a better match to the boundary conditions if the output port of the input/output waveguide channel 20(*a* and *b*) is a simple horn. This is because the uniform amplitude distribution in the E-plane of the horn matches the uniform distribution of the radial wave in cavity 15(*a* and *b*). Structures for generating this mode, in general, have a narrow bandwidth. However, by adding radial conducting walls 17(*a* and *b*) and 18(*a* and *b*) on an arc of less than 360°, a simpler broadband input can be used.

During experiments with the described power divider/combiner, it was discovered that uniform radial fields exist only for angles between side walls 17(*a* and *b*) and 18(*a* and *b*) such that single or multiple reflections of a ray from the input aperture of channel 20(*a* and *b*) and the edge of walls 17(*a* and *b*) and 18 become either parallel to walls 17(*a* and *b*) and 18(*a* and *b*) or a bisector of walls 17(*a* and *b*) and 18(*a* and *b*). Angles which meet the above criteria are 180°, 90°, 60°, 45°, and many smaller angles which are not practical for power divider/combiner implementations. It was also discovered that there is an optimum source aperture of channel 20(*a* and *b*) for uniform fields. In referring to FIG. 2, the source aperture is designated 27(*a* and *b*) and is the end of channel 20 in communication with cavity 15(*a* and *b*). The opposite end of channel 20(*a* and *b*), or the exterior opening end is designated 29(*a* and *b*). In the experiments with the present specific structure the end 29(*a* and *b*) of channel 20(*a* and *b*) has a width (the dimension in the plane of base member 10) of 0.112 inches and the source aperture 27(*a* and *b*) has a width of 0.070 inches plus or minus 0.001 inches, or a taper of at least 37 percent. The taper of channel 20(*a* and *b*) from end 29(*a* and *b*) to end 27(*a* and *b*) should be linear. It will of course be understood that a power divider/combiner with an untapered, or less tapered, input/output waveguide channel will operate but there is substantial droop, or nonuniformity, in the radial field. By producing a uniform radial field in cavity 15(*a* and *b*) and by positioning a plurality of output/input waveguide channels around the circumference of cavity 15(*a* and *b*), the output/input channels being equally spaced around the circumference and of equal radial length, a power divider/combiner is provided which requires no additional phase shifters and which produces signals of equal amplitude and phase.

With a pair of power divider/combiners connected so that one serves as a divider with the plurality of outputs thereof amplified and connected to a plurality of inputs of the second device operating as a combiner, it has been found that a plurality of spaced apart spikes appear in the final amplified output signal. The spacing between the spikes is determined by the radial dimension of cavity 15 with the spacing becoming smaller as the radial dimension of cavity 15(*a* and *b*) is increased. For example, the radial dimension of cavity 15(*a* and *b*) in the present specific embodiment is approximately five wavelengths at the operating frequency and the spikes appear at approximately four gigahertz intervals. As the radial dimension of cavity 15(*a* and *b*) is reduced the spacing of the spikes is increased, but the power divider/combiner becomes increasingly difficult to construct.

It should also be noted that the position of the spikes in the output signal can be altered by very small changes in the radial dimension of cavity 15(*a* and *b*). For example, if the radial dimension of cavity 15(*a* and *b*) is exactly five wavelengths a spike may appear in the center of the band of interest. However, by altering the radial dimension of cavity 15(*a* and *b*) plus or minus five percent the spikes can be moved anywhere in the band. Thus, in the construction of the power divider/combiner the radial distance of cavity 15(*a* and *b*) is selected roughly, in wavelengths, to provide a spacing between spikes which will be greater than the desired bandwidth of the apparatus, while still providing the easiest construction, and then adjusting the radial distance to move the spikes out of the band of interest. It should also be noted that the spikes may be reduced by providing compensation 30 in the plurality of output/input waveguide channels 25(*a* and *b*) (similar to inductance 22 in channel 20(*a* and *b*)) to compensate for reactive components therein and reduce standing waves.

While the present specific embodiment of the power divider/combiner is constructed with the base member 10 formed in two pieces 11 and 12 which are mirror images of each other, it will be understood by those skilled in the art that a single piece might be constructed with the channels and cavity formed twice as deep so that a second piece affixed thereto to enclose the structure could essentially be a flat plate. This embodiment would not be as desireable as the present embodiment because there would be more leakage and losses. In the present embodiment the space between pieces 11 and 12 appears at the exact center of the long dimension of the waveguides so that current flowing at the space is at a minimum. Thus, the space between pieces 11 and 12 has substantially no effect on the electric fields and currents within the divider/combiner.

Thus, an improved power divider/combiner is illustrated and described which is capable of providing a plurality of equal amplitude and phase signals without requiring any additional phase shifters or the like. Also, the complexity of the input is substantially reduced so that the overall complexity and cost of construction is substantially improved.

While, we have shown and described a specific embodiment of this invention, further modifications and improvements will occur to those skilled in the art. We desire it to be understood, therefore, that this invention is not limited to the particular form shown and we intend in the appended claims to cover all modifications which do not depart from the spirit and scope of this invention.

We claim:

1. A power divider/combiner comprising:

a base member formed of electrically conductive material and defining a generally fan shaped waveguide cavity therein having a pair of side walls which extend from an apex radially outwardly in a plane through said base member;

an input/output waveguide channel formed in said base member in communication with said waveguide cavity generally at said apex and lying generally in said plane; and a plurality of output/input waveguide channels formed in said base member in communication with said waveguide cavity, said output/input channels extending radially outwardly from said cavity between said side walls with substantially equal lengths and equal angular spacings therebetween and lying generally in said plane.

2. A power divider/combiner as claimed in claim 1 wherein the side walls include a total angle therebetween, said total angle selected from one of the group of angles consisting of 180 degrees, 90 degrees, 60 degrees, and 45 degrees.

3. A power divider/combiner as claimed in claim 2 wherein the total angle included between the side walls is approximately 90°.

4. A power divider/combiner as claimed in claim 1 wherein each of the output/input waveguide channels form a junction with the waveguide cavity generally at a radially innermost end of each of said output/input waveguide channels and the spacings between adjacent output/input waveguide channels are tapered in the plane to substantially a point at the junction of the output/input waveguide channels and the waveguide cavity.

5. A power divider/combiner as claimed in claim 4 wherein the points of the tapered spacings are each spaced an equal distance from the apex of said side walls.

6. A power divider/combiner as claimed in claim 5 wherein the equal distance is less than approximately five wavelengths at a center frequency of operation.

7. A power divider/combiner as claimed in claim 1 including a reactance engaged in the input/output waveguide channel to reduce standing waves.

8. A power divider/combiner as claimed in claim 1 including a reactance engaged in each of the output/input waveguide channels to reduce standing waves.

9. A power divider/combiner as claimed in claim 1 wherein the base member is formed of two pieces each of which is a mirror image of the other.

10. A power divider/combiner as claimed in claim 1 wherein the input/output waveguide channel is tapered from an end external to the base member to an end in communication with the cavity.

11. A power divider/combiner as claimed in claim 10 wherein the input/output waveguide channel tapers from approximately 0.112 inches wide in the plane to approximately 0.070 inches wide in the plane.

* * * * *